US005373132A

United States Patent [19]

Achermann et al.

[11] Patent Number: 5,373,132

[45] Date of Patent: Dec. 13, 1994

[54] SWITCH APPARATUS WITH SIGNAL LIGHT

[75] Inventors: Peter Achermann, Ebikon; Reto Gränicher, Hordw, both of Switzerland

[73] Assignee: Inventio AG, Hergiswil, Switzerland

[21] Appl. No.: 995,886

[22] Filed: Dec. 23, 1992

[30] Foreign Application Priority Data

Dec. 24, 1991 [CH] Switzerland ..... 03845/91-6

[51] Int. Cl.[5] ..... H01H 9/00

[52] U.S. Cl. ..... 200/310; 200/313; 200/314; 200/520

[58] Field of Search ..... 200/310, 313, 314, 315, 200/296, 520

[56] References Cited

U.S. PATENT DOCUMENTS

| | | | |
|---|---|---|---|
| 3,467,802 | 9/1969 | Martin | 200/314 |
| 4,283,758 | 8/1981 | Irving | 362/251 |
| 4,499,352 | 2/1985 | Fujita et al. | 200/296 |
| 4,683,359 | 7/2887 | Wojtanek | 200/314 |
| 4,758,701 | 7/1988 | Nagel | 200/314 |
| 5,099,095 | 3/1992 | Torma et al. | 200/314 |

FOREIGN PATENT DOCUMENTS

| | | |
|---|---|---|
| 0184186 | 6/1986 | European Pat. Off. . |
| 2825686 | 5/1979 | Germany . |

*Primary Examiner*—Henry J. Recla
*Assistant Examiner*—David J. Walczak
*Attorney, Agent, or Firm*—Howard & Howard

[57] ABSTRACT

A switch apparatus includes a cap having an axially extending flange for mounting in an opening of a cover plate and a releasably attached switch carrier. A signal light element is slidably mounted inside the cap and has a hollow, cylindrical head portion. Extending from a rear surface of the head portion are a pair of guides and a push rod. A sleeve threadably engages threaded exterior surface of a side wall a switch carrier, a forward end of the sleeve and the flange of the cap engaging opposite sides of the cover plate and retaining the switch apparatus in the opening. Provided at the rearward end of the switch carrier are board holders which retain a rear circuit board on which is mounted a microswitch actuated by the push rod. Positioned in the head portion of the signal light element is an annular light conductor and a front circuit board which has light-emitting semiconductors integrated thereon. Light from the light-emitting semiconductors is conducted by the annular light conductor to the peripheral edge of a transparent plate closing off the forward end of the head portion. The light-emitting semiconductors are regulated by photo semiconductors in dependence on the ambient light, so that the light ring lights up brighter the brighter the ambient light is. A flexible multi-wire conductor connects the front circuit board with the rear circuit board whereby actuation of the microswitch activates the light-emitting semiconductors.

14 Claims, 2 Drawing Sheets

SWITCH APPARATUS WITH SIGNAL LIGHT

BACKGROUND OF THE INVENTION

The present invention relates generally to lighted switches and, in particular, to an elevator switch apparatus with a signal light.

There is shown in the German Utility Model document GM-U1 79 27 642 a pushbutton switch, for generating signals to elevator controls, which includes an actuating element which is pressed to actuate a microswitch, and a head portion. The head portion is formed of light-permeable plastic material and a light-impermeable plate is centrally located in the contact surface. Thus, the contact surface is illuminated at its edge by a light source provided in the interior of the pushbutton.

A disadvantage of this known device is that the switch actuating forces applied to the head portion are directly transmitted through the actuating element to the circuit board carrying the microswitch. A further disadvantage is that the actuating element, which is square in cross section and telescopically displaceable in a socket, tends to be damaged by jamming.

SUMMARY OF THE INVENTION

The present invention concerns a switch apparatus including a signal light element having a light source and which is guided by a switch carder, and a switch which is mounted on a rear circuit board and actuated by the signal light element. The signal light element has a pair of axially extending guides formed thereon and the switch carrier has a pair of slide surfaces formed thereon upon which the guides slide during displacement of the signal light element. The switch cap is releasably attached to the switch carrier and has a radially extending flange formed thereon. The switch carrier has a threaded exterior surface and a sleeve threadably engaging the threaded exterior surface whereby a forward end of the sleeve and the flange of the switch cap engage opposite sides of a cover plate for mounting the switch assembly in an opening in the cover plate. A pair of snap catches extend radially outwardly from the switch carrier for engaging the switch cap to releasably attach the switch carder to the switch cap. A pair of securing elements are rotatably attached to the switch carrier for locking the snap catches. A rear circuit board is attached to the switch carrier for mounting a switch actuated by displacement of the signal light element toward the rear circuit board.

The light source includes light-emitting semiconductors on a front circuit board mounted in the signal light element. A transparent plate having a central light-impermeable screen is positioned at a forward end of the signal light element. An annular light conductor is mounted between the light source and the transparent plate for conducting light generated from the light source as a ring about a peripheral edge of the transparent plate.

The present invention remedies the disadvantages of the above described switch. Thus, the invention provides a relatively low cost and reliable switch for generating a control signal and an acknowledgement upon actuation and which also automatically adjusts the brightness of the signal light in accordance with the ambient light. A further advantage of the switch apparatus according to the present invention is that it can be manufactured with few components and by simple assembly.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
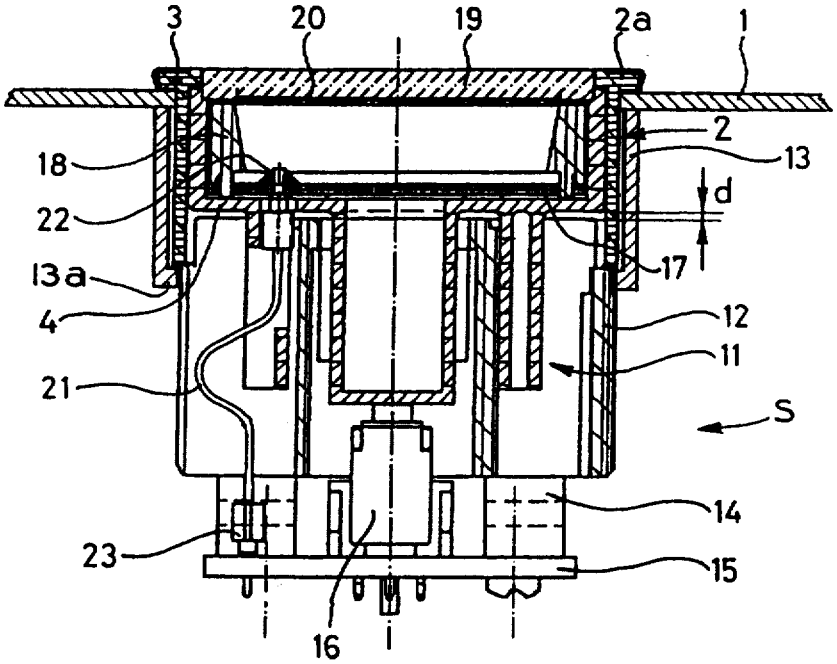
FIG. 1 is a top plan view in cross section of a signal apparatus with signal light according to the present invention.
Figure 2:
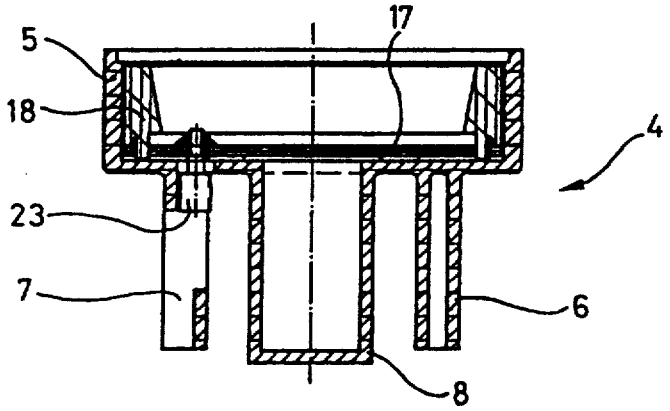
FIG. 2 is a top plan view in cross section of the signal light element shown in the FIG. 1.
Figure 3:
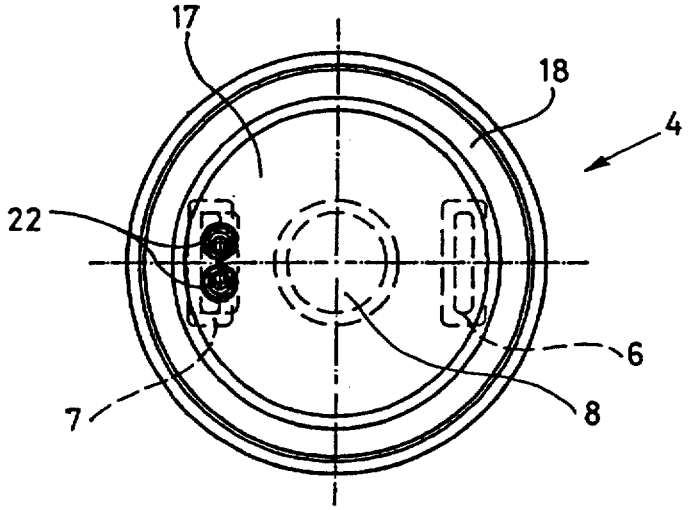
FIG. 3 is a front elevation view of the signal light element shown in the FIG. 2.
Figure 4:
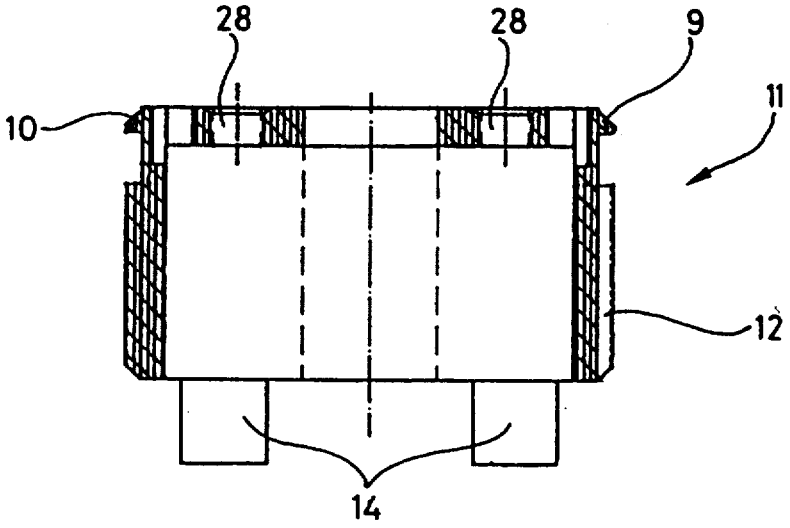
FIG. 4 is a top plan view in cross section of the switch carrier shown in the FIG. 1.
Figure 5:
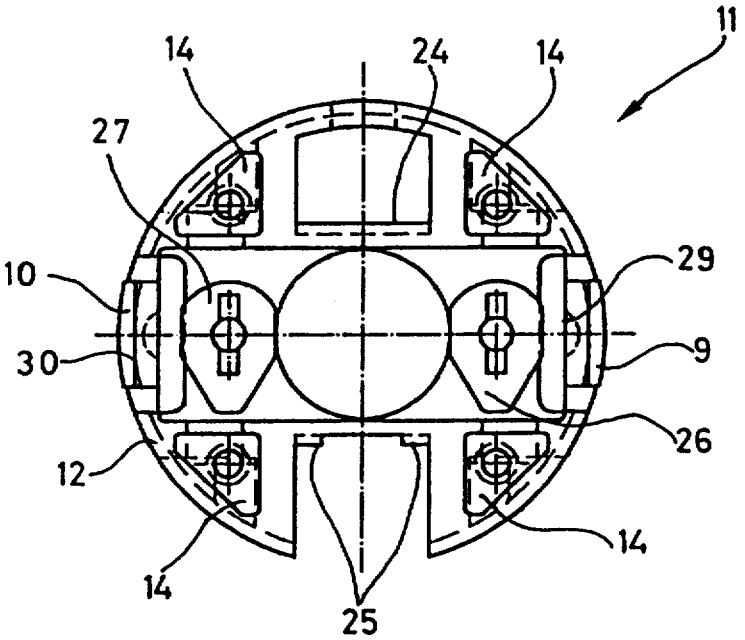
FIG. 5 is a rear elevational view of the switch carrier shown in the FIG. 4.
Figure 6:
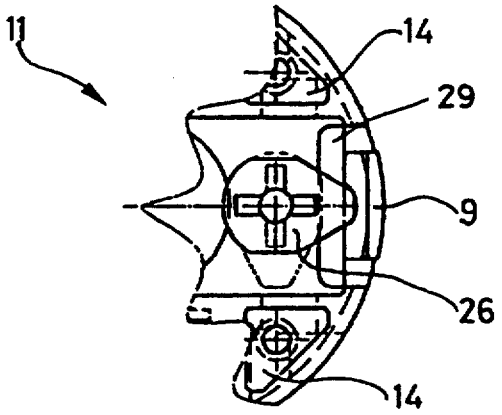
FIG. 6 is a fragmentary view similar to the FIG. 5 showing the switch carrier with a secured snap catch.

There is shown in the FIG. 1 a cover plate 1 with an opening formed therein in which a switch apparatus S is retained. A forward open end of a generally tubular switch cap 2 extends through the opening. On the exterior or user side of the cover plate 1, the cap 2 includes an annular shoulder or axially outwardly extending flange 2*a* which retains an annular diaphragm or seal 3. Positioned at the forward end of and inside the cap 2, and displaceable along the longitudinal axis of the cap, is a signal light element 4. As shown in the FIGS. 1–3, the signal light element 4 has a hollow, generally cylindrical head portion 5 with a first guide 6, a second guide 7 and a push rod 8 each extending rearwardly from a rearward end wall of the head portion 5. The forward end of the head portion 5 is open and is positioned in the open forward end of the cap 2 at the user side of the cover plate 1. The first guide 6 is hollow and generally rectangular in cross section and is spaced radially from the push rod 8. The second guide 7 is similar to the first guide, but with portions of the walls cut away for access to electrical terminals, and is spaced radially from the push rod 8 diametrically opposite the first guide 6. The push rod 8 is hollow and generally cylindrical in cross section, open at one end to the interior of the head portion 5 and closed at an opposite rearward end, and is located on the longitudinal axis of the cap 2.

As shown in the FIGS. 1 and 4–6, a generally tubular switch carrier 11 is positioned inside the switch cap 2 and behind the signal light element 4. A first snap catch 9 and a second snap catch 10 extend radially outwardly from the forward end of the switch carrier 11 and detent in a pair of openings (not shown) formed in the side wall of the cap 2. A thread 12 is formed on the exterior of the side wall of the switch carrier 11. A sleeve 13 slides over the switch carrier 11 and has formed at a rearward end thereof a radially inwardly extending flange 13*a* which is internally threaded for cooperating with the thread 12 to permit the sleeve to be rotationally advanced until a forward end of the sleeve 13 and the flange 2*a* of the cap 2 form a firm seat on opposite sides of the cover plate 1. The thread 12 and the threaded sleeve 13 permit installation of the switch assembly on cover plates having different material thicknesses.

Formed at the rearward end of the switch carrier 11 are a plurality of board holders 14 extending rearwardly for retaining a rear or second circuit board 15 as shown in the FIG. 1. A microswitch 16 is mounted on the forward facing side of the circuit board 15 for actuation by the push rod 8. A not-illustrated electrical plug is also mounted on the circuit board 15 and is connected to the microswitch 16 by a printed circuit. The electrical plug can be used to transmit signals generated by the microswitch 16 to an elevator control.

Positioned in the head portion 5 of the signal light element 4 is an annular light conductor 18 which is connected to a front or first circuit board 17. The conductor 18 conducts the light generated from a plurality of light-emitting semiconductors integrated with the front circuit board 17 to the rearward side of a transparent plate 19 (FIG. 1 ) closing off the open forward end of the signal light element 4. The central area of the rearward side of the transparent plate 19 not adjacent to the light conductor 18 is provided with a printed light-impermeable screen 20, whereby a light ring conducted by the conductor 18 is only visible at the peripheral edge of the transparent plate 19 as an acknowledgement signal to a user of the switch apparatus. The light-emitting semiconductors are regulated by photo semiconductors in an automatic brightness regulation circuit (not shown) in dependence on the ambient light, so that the light ring visible on the transparent plate 19 is lit more brightly the brighter the ambient light is. The front circuit board 17, including the light-emitting semiconductors and the automatic brightness regulation circuit, and the light conductor 18 are commercially available devices. A flexible multi-wire conductor 21 connects the front circuit board 17 with the rear circuit board 15 wherein solder points 22 attach electrical plug sockets 23 to the circuit board 17 and other plug sockets 23 are mounted on the circuit board 15 with opposite ends of the conductor 21 engaging respective ones of the plug sockets 23. Thus, electrical power supplied to the rear circuit board 15 can be applied to the front circuit board 17 through the conductor 21, for example, when the microswitch 16 is actuated to activate the light-emitting semiconductors and the automatic brightness regulation circuit.

In an alternate embodiment of the present invention, any suitable light source with or without brightness regulation can be used instead of the light-emitting semiconductors and brightness regulation circuit on the front circuit board 17 and the light conductor 18.

The signal light element 4 is displaced along the path corresponding to the longitudinal axis of the switch apparatus S a distance d (FIG. 1) upon force being applied to the front or user side of the transparent plate 19, wherein the first guide 6 slides on a slide surface 24 (FIG. 5) and the second guide 7 slides on a slide surface provided by a pair of shoulders 25 (FIG. 5) all formed in a forward wall of the switch carrier 11. Prior to the rearward surface of the head portion 5 engaging the forward edge of the switch carrier 11 thereby stopping travel, the push rod 8 engages and actuates the microswitch 16. As the forward end of the switch carrier 11 is being inserted into the rearward end of the switch cap 2 during assembly, the snap catches 9 and 10 are forced radially inwardly by the interior wall of the switch cap 2. When the snap catches 9 and 10 are aligned with the openings (not shown) in the cap 2, the snap catches are free to move radially outwardly releasably attaching the cap 2 and switch carrier 11 together. The snap catches 9 and 10 are locked in this position by cooperating first and second cam shaped securing elements 26 and 27 respectively which are rotatably mounted in a pair of apertures 28 formed in the switch carder 11. In the locked setting shown in the FIG. 6, a cam portion of the first securing element 26 is rotated into a first recess 29 formed adjacent the first snap catch 9 to prevent the snap catch 9 from being forced radially inwardly thereby releasing the cap 2. In a similar manner, the second securing element 27, shown in the unlocked setting in the FIG. 5, can be rotated into a second recess 30 formed adjacent the second snap catch 10.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A switch apparatus for mounting in an opening in a cover plate including a signal light element in which a light source is mounted, a switch carder for guiding sliding movement of the signal light element, and a switch actuated by the signal light element, comprising:

a signal light element having at least one axially extending guide formed thereon;

a switch carrier having a least one slide surface formed thereon upon which said guide slides during displacement of said signal light element and having a threaded exterior surface;

a switch cap releasably attached to said switch carrier and having a radially extending flange formed thereon;

at least one snap catch on said switch carrier for engaging said switch cap to releasable, attach said switch carrier to said switch cap;

at least one securing element attached to said switch carrier for locking said snap catch, said securing element being rotatably mounted in an aperture formed in said switch carrier and rotating into a recess formed in said switch carrier said snap catch to lock said snap catch;

a sleeve threadably engaging said threaded exterior surface of said switch carrier, a forward end of said sleeve and said flange of said switch cap adapted to engage opposite sides of a cover plate for mounting the switch apparatus in an opening in the cover plate; and a rear circuit board attached to said switch carrier for mounting a switch actuated by displacement of said signal light element toward said rear circuit board.

2. The switch apparatus according to claim 1 wherein at least one board holder is formed on said switch carder and said rear circuit board is mounted on said board holder.

3. The switch apparatus according to claim 1 wherein said signal light element includes a hollow head portion formed at a forward end thereof and a light source mounted in said head portion, said light source being formed of a plurality of light-emitting semiconductors on a front circuit board for generating light.

4. The switch apparatus according to claim 3 wherein said light source regulates said light in dependence on ambient light from a user side of a cover plate when the switch apparatus is mounted in an opening in the cover plate.

5. The switch apparatus according to claim 3 wherein said front circuit board is electrically connected with said rear circuit board by a flexible multi-wire conductor.

6. The switch apparatus according to claim 3 wherein said signal light element includes an annular light conductor in said head portion and a transparent plate having a central light-impermeable screen and being positioned at a forward end of said head portion, said light conductor conducting light generated from said light source as a ring about a peripheral edge of said transparent plate.

7. The switch apparatus according to claim 6 wherein said light source regulates said light in dependence on ambient light from a user side of a cover plate when the switch apparatus is mounted in an opening in the cover plate.

8. The switch apparatus according to claim 1 wherein said signal light element includes a hollow head portion formed at a forward end thereof and a light source including a front circuit board mounted in said head portion.

9. The switch apparatus according to claim 8 wherein said front circuit board is electrically connected with said rear circuit board by a flexible multi-wire conductor.

10. A switch apparatus for mounting in an opening in a cover plate including a signal light element in which a light source is mounted, a switch carrier for guiding sliding movement of the signal light element, and a switch actuated by the signal light element, comprising:

a signal light element having a pair of axially extending guides formed thereon;

a switch carrier having a pair of slide surfaces formed thereon upon which said guides slide during displacement of said signal light element and having a threaded exterior surface;

a switch cap releasably attached to said switch carrier and having a radially extending flange formed thereon;

a pair of snap catches extending radially outwardly from said switch carrier for engaging said switch cap to releasably attach said switch carrier to said switch cap;

a pair of securing elements attached to said switch carrier for locking said snap catches;

a sleeve threadably engaging said threaded exterior surface of said switch carrier, a forward end of said sleeve and said flange of said switch cap adapted to engage opposite sides of a cover plate for mounting the switch apparatus in an opening in the cover plate; and a rear circuit board attached to said switch carrier for mounting a switch actuated by displacement of said signal light element toward said rear circuit board.

11. The switch apparatus according to claim 10 wherein said signal light element includes a hollow head portion formed at a forward end thereof and a light source mounted in said head portion, said light source being formed of a plurality of light-emitting semiconductors on a front circuit board for generating light.

12. The switch apparatus according to claim 11 wherein said light generated by said light source is regulated in dependence on ambient light from a user side of a cover plate when the switch apparatus is mounted in an opening in the cover plate.

13. The switch apparatus according to claim 11 wherein said signal light element includes an annular light conductor in said head portion and a transparent plate positioned at a forward end of said head portion, said transparent plate having a central light-permeable screen, said light conductor conducting light generated from said light source as a ring about a peripheral edge of said transparent plate.

14. A switch apparatus for mounting in an opening in a cover plate including a signal light element in which a light source is mounted, a switch carrier for guiding sliding movement of the signal light element, and a switch actuated by the signal light element, comprising:

a signal light element having a pair of axially extending guides formed thereon;

a light source including a front circuit board mounted in said signal light element;

a transparent plate having a central light-impermeable screen and being positioned at a forward end of said signal light element;

an annular light conductor mounted between said light source and said transparent plate for conducting light generated from said light source as a ring about a peripheral edge of said transparent plate;

a switch carrier having a pair of slide surfaces formed thereon upon which said guides slide during displacement of said signal light element and having a threaded exterior surface;

a switch cap releasably attached to said switch carrier and having a radially extending flange formed thereon;

a pair of snap catches extending radially outwardly from said switch carrier for engaging said switch cap to releasably attach said switch carrier to said switch cap;

a pair of securing elements attached to said switch carrier for locking said snap catches;

a sleeve threadably engaging said threaded exterior surface of said switch carrier, a forward end of said sleeve and said flange of said switch cap adapted to engage opposite sides of a cover plate for mounting the switch apparatus in an opening in the cover plate; and a rear circuit board attached to said switch carrier for mounting a switch actuated by displacement of said signal light element toward said rear circuit board.

* * * * *